US010096300B2

(12) United States Patent
Cheon et al.

(10) Patent No.: US 10,096,300 B2
(45) Date of Patent: Oct. 9, 2018

(54) LUMINANCE COMPENSATOR IN DISPLAY DEVICE

(71) Applicant: SAMSUNG DISPLAY CO., LTD., Yongin-si, Gyeonggi-Do (KR)

(72) Inventors: Man-Bok Cheon, Yongin-si (KR); So-Young Kim, Yongin-si (KR); Jin-Ho Lee, Hwaseong-si (KR); Woo-Seok Jang, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 84 days.

(21) Appl. No.: 15/408,975

(22) Filed: Jan. 18, 2017

(65) Prior Publication Data

US 2017/0236490 A1 Aug. 17, 2017

(30) Foreign Application Priority Data

Feb. 17, 2016 (KR) ..... 10-2016-0018343

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2310/08* (2013.01); *G09G 2320/0233* (2013.01); *G09G 2320/041* (2013.01)

(58) Field of Classification Search
CPC ..... G09G 2320/041; G09G 3/2944; G09G 3/3233; G09G 3/32
See application file for complete search history.

(56) References Cited

U.S. PATENT DOCUMENTS 8,237,651 B2 * 8/2012 Hasegawa ..... G09G 3/3233 345/101
2002/0033814 A1 * 3/2002 Kasahara ..... G09G 3/2944 345/204
2006/0022616 A1 * 2/2006 Furukawa ..... G02F 1/133603 315/309
2012/0206426 A1 * 8/2012 Sakakima ..... G09G 3/3426 345/207
2012/0274544 A1 * 11/2012 Nakajima ..... G01K 7/42 345/101

FOREIGN PATENT DOCUMENTS

KR 10-2005-0016195 2/2005
KR 10-2014-0078919 6/2014

* cited by examiner

*Primary Examiner* — Sepehr Azari
(74) *Attorney, Agent, or Firm* — F. Chau & Associates, LLC.

(57) ABSTRACT

A luminance compensator in a display device includes a temperature sensor that detects a temperature of a display panel, a temperature estimator that calculates an estimated temperature of each of a plurality of pixel blocks based on an average luminance of each pixel block and the temperature of the display panel, a first weight calculator that detects a displacement of the display panel and calculates a first temperature compensation weight for first compensation pixel blocks of the pixel blocks, the first compensation pixel blocks being adjacent to an upper side of an image pattern area displayed on a portion of the display panel, and a temperature compensator that calculates temperature compensation data by applying the first temperature compensation weight to the estimated temperature to compensate the average luminance, and outputs the temperature compensation data.

20 Claims, 11 Drawing Sheets

LUMINANCE COMPENSATOR IN DISPLAY DEVICE

CROSS REFERENCE TO RELATED APPLICATION

This application claims priority under 35 USC § 119 from, and the benefit of, Korean Patent Application No. 10-2016-0018343, filed on Feb. 17, 2016 in the Korean Intellectual Property Office (KIPO), the contents of which are herein incorporated by reference in their entirety.

BACKGROUND

1. Technical Field

Exemplary embodiments of the inventive concept are directed to display devices. More particularly, exemplary embodiments of the inventive concept directed to luminance compensators included in the display device.

2. Discussion of Related Art

A display device, such as an organic light emitting display device, accumulates image data per pixel or per pixel block using a luminance correction technique and compensates stress, such as luminance variations or degradation, to eliminating an afterimage, luminance spots, etc. For example, stress may accumulate based on a current flowing into each sub-pixel, the emission time of each sub-pixel, the temperature of a display panel, etc. Accordingly, there may be a need to calculate temperature by location in the display panel to increase the accuracy of the luminance correction.

For accurate temperature calculations, a number of temperature sensors should be placed in the display panel. However, increasing the number of temperature sensors can increase manufacturing costs. Further, it can be challenging to attach temperature sensors to a back side of a display panel, such as a transparent display panel, a mirror display panel, etc.

SUMMARY

Exemplary embodiments can provide a luminance compensator in a display device that generates temperature compensation data based on thermal diffusion inside of a display panel or by luminance differences of image patterns.

According to exemplary embodiments, a display device includes a temperature sensor that detects a temperature of a display panel, a temperature estimator that calculates an estimated temperature of each of a plurality of pixel blocks based on average luminance of each of the pixel blocks and the temperature of the display panel, a first weight calculator that detects a placement of the display panel and calculates a first temperature compensation weight of first compensation pixel blocks of the pixel blocks, the first compensation pixel blocks being adjacent to an upper side of an image pattern area displayed on a portion of the display panel, and a temperature compensator that calculates temperature compensation data by applying the first temperature compensation weight to the estimated temperature to compensate the average luminance, and outputs the temperature compensation data.

In exemplary embodiments, the first weight calculator may determine the first temperature compensation weight based on thermal diffusion inside the display panel that results from a displacement of the display panel.

In exemplary embodiments, the first weight calculator may select the first compensation pixel blocks based on the placement of the display panel.

In exemplary embodiments, the placement of the display panel may be determined based on a degree of rotation of the display panel when a display surface of the display panel is vertical with respect to a predetermined reference horizontal plane.

In exemplary embodiments, the placement of the display panel may be determined based on a displacement angle between a predetermined reference horizontal plane and a display surface of the display panel, the first weight calculator may calculates the first temperature compensation weight when the displacement angle is greater than or equal to a predetermined threshold angle, and the first weight calculator may adjust the first temperature compensation weight based on the placement angle.

In exemplary embodiments, the first weight calculator may include a placement detector that detects the placement of the display panel based on a displacement angel between a predetermined reference horizontal plane and a display surface of the display panel and a degree of rotation of the display panel, a compensation block determiner that determines first compensation pixel blocks adjacent to an upper side of an image pattern area displayed on a portion of the display panel, and a weight determiner that determines the first temperature compensation weight based on the average luminance and the displacement angle.

In exemplary embodiments, the temperature compensator may perform one of adding the first temperature compensation weight to the estimated temperature, or scaling the first temperature compensation weight by the estimated temperature.

In exemplary embodiments, the luminance compensator may further include a second weight calculator that calculates a second temperature compensation weight of second compensation pixel blocks of the pixel blocks based on a distance between a first pattern area having a first luminance and a second pattern area having a second luminance lower than the first luminance, the second pixel blocks being included the second pattern area, where the second weight calculator may decrease the second temperature compensation weight as the distance increases.

In exemplary embodiments, the temperature compensator may further apply the second temperature compensation weight to the temperature compensation data.

According to exemplary embodiments, a luminance compensator in a display device includes a temperature sensor that detects a temperature of a display panel, a temperature estimator that calculates an estimated temperature of each of a plurality of pixel blocks based on an average luminance of each pixel block and the temperature of the display panel, a first weight calculator that calculates a first temperature compensation weight of first compensation pixel blocks of the pixel blocks based on a distance between a first pattern area having a first luminance and a second pattern area having a second luminance lower than the first luminance, the second pixel blocks being included the second pattern area, and a temperature compensator that calculates temperature compensation data by applying the first temperature compensation weight to the estimated temperature to compensate the average luminance, and outputs the temperature compensation data.

In exemplary embodiments, the first weight calculator may apply the first temperature compensation weight to at least a portion of the second pattern area based on thermal conduction resulting from temperature differences between the first pattern area and the second pattern area.

In exemplary embodiments, the first weight calculator may decrease the second temperature compensation weight as the distance increases.

In exemplary embodiments, the first weight calculator may include a luminance map calculator that extracts a luminance map that matches each of the pixel blocks with the average luminance in a frame, and determine the first pattern area, the second pattern area, and a middle area between the first and second pattern areas based on the luminance map, the middle area having a luminance below a predetermined threshold luminance, a distance calculator that calculates the distance between a first maximum luminance block in the first pattern area and a second maximum luminance block in the second pattern area, and a weight determiner that determines the first compensation pixel blocks and the first temperature compensation weight based on the distance.

In exemplary embodiments, the weight determiner may determine the first temperature compensation weight of each of the first compensation pixel blocks differently based on a relative distance between the first maximum luminance block and each of the first compensation pixel blocks, may adjust the first temperature compensation weight based on a luminance difference between the first maximum luminance block and the second maximum luminance block, and, the distance calculator does not calculate the distance when no middle area is detected between the first and second pattern areas.

In exemplary embodiments, the luminance compensator may further include a second weight calculator that detects a displacement of the display panel and calculates a second temperature compensation weight of second compensation pixel blocks of the pixel blocks, the second compensation pixel blocks being adjacent to an upper side of an image pattern area displayed on a portion of the display panel.

According to exemplary embodiments, a luminance compensator in a display device includes a temperature sensor that detects a temperature of a display panel, a temperature estimator that calculates an estimated temperature of each of a plurality of pixel blocks based on an average luminance of each pixel block and the temperature of the display panel, a first weight calculator that detects a placement of the display panel and calculates a first temperature compensation weight for first compensation pixel blocks of the pixel blocks, the first compensation pixel blocks being adjacent to an upper side of an image pattern area displayed on a portion of the display panel, and a second weight calculator that calculates a second temperature compensation weight for second compensation pixel blocks of the pixel blocks based on a distance between a first pattern area having a first luminance and a second pattern area having a second luminance lower than the first luminance, the second pixel blocks being included the second pattern area.

In exemplary embodiments, the luminance compensator may further include a temperature compensator that calculates temperature compensation data by applying the first temperature compensation weight and the second temperature compensation weight to the estimated temperature to compensate the average luminance, and outputs the temperature compensation data.

In exemplary embodiments, the first weight calculator may include a placement detector that detects the placement of the display panel based on a displacement angel between a predetermined reference horizontal plane and a display surface of the display panel and a degree of rotation of the display panel, a compensation block determiner that determines first compensation pixel blocks adjacent to an upper side of an image pattern area displayed on a portion of the display panel, and a weight determiner that determines the first temperature compensation weight based on the average luminance and the displacement angle.

In exemplary embodiments, the second weight calculator may include a luminance map calculator that extracts a luminance map that matches each of the pixel blocks with the average luminance in a frame, and determines the first pattern area, the second pattern area, and a middle area between the first and second pattern areas based on the luminance map, the middle area having a luminance below a predetermined threshold luminance, a distance calculator that calculates the distance between a first maximum luminance block in the first pattern area and a second maximum luminance block in the second pattern area, and a weight determiner that determines the first compensation pixel blocks and the first temperature compensation weight based on the distance.

In exemplary embodiments, the weight determiner may determine the first temperature compensation weight of each of the first compensation pixel blocks differently based on a relative distance between the first maximum luminance block and each first compensation pixel block, and may adjust the first temperature compensation weight based on luminance differences between the first maximum luminance block and the second maximum luminance block. The distance calculator does not calculate the distance when no middle area is detected between the first and second pattern.

Therefore, a luminance compensator in a display device according to exemplary embodiments can apply a first temperature compensation weight concerned with the thermal convection based on the placement of the display panel or a second temperature compensation weight concerned with the thermal conduction based on the luminance difference between pattern areas in the temperature compensation data, to improve the accuracy of a temperature calculation and to improve the compensation of image data in the pixel blocks. Thus, luminance compensation capability of a luminance compensator for eliminating degradation and after-images can be improved. In addition, since the number of the temperature sensors for the display panel decreases, manufacturing costs of the display device can be reduced.

DETAILED DESCRIPTION OF EXEMPLARY EMBODIMENTS

Exemplary embodiments will be described more fully hereinafter with reference to the accompanying drawings, in which various embodiments are shown.

Figure 1:
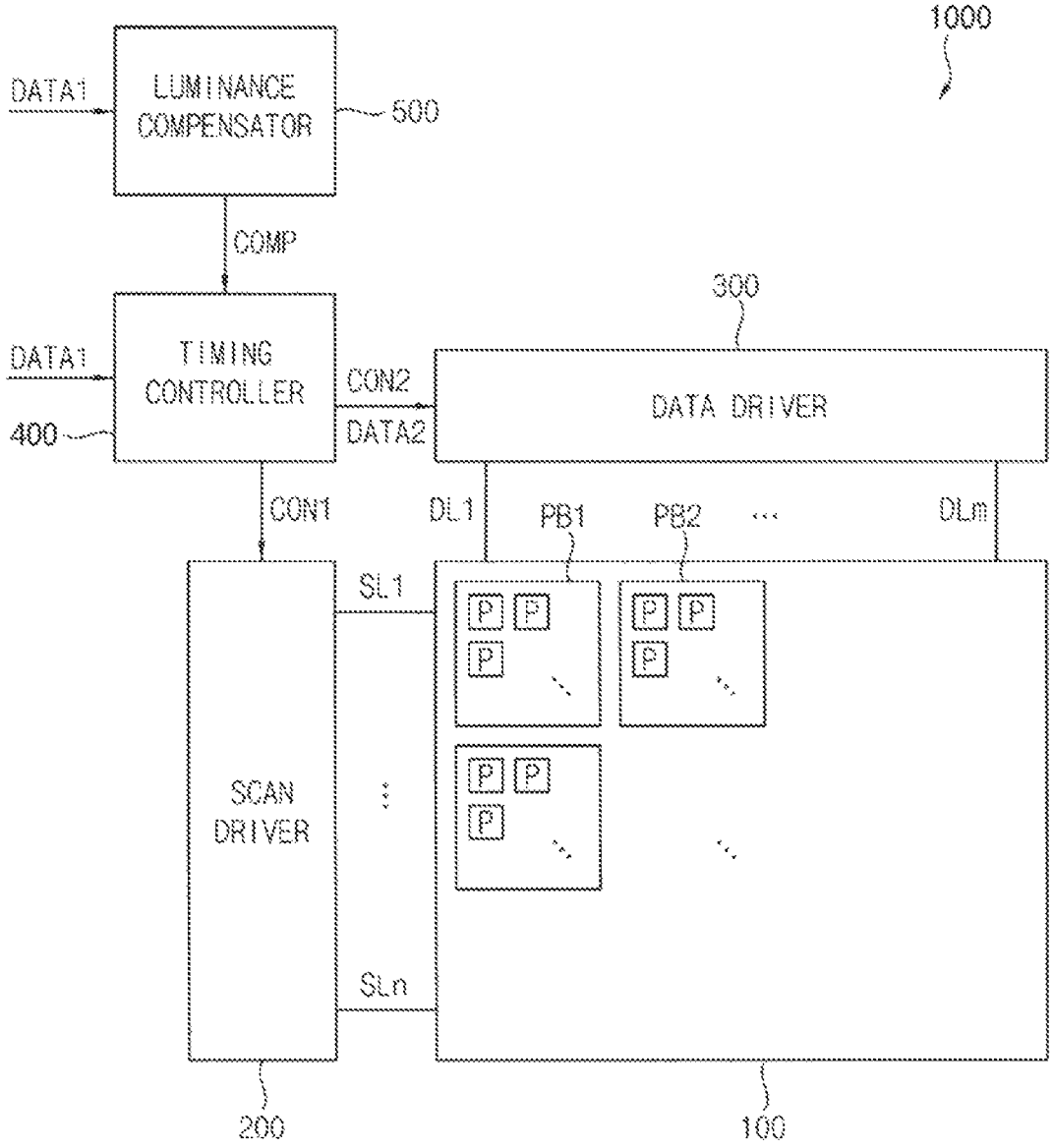
FIG. 1 is a block diagram of a display device according to exemplary embodiments.

FIG. 1 is a block diagram of a display device according to exemplary embodiments.

Referring to FIG. 1, a display device 1000 may include a display panel 100, a scan driver 200, a data driver 300, a timing controller 400, and a luminance compensator 500.

The display device may be an organic light emitting display device, a liquid crystal display device, etc. In some embodiments, the display device 1000 may be a large size display device having a transparent display device, a mirror display device, etc.

According to exemplary embodiments, the display panel 100 includes a plurality of pixels P which display images. That is, the pixels P are respectively arranged at locations that correspond to crossing regions of a plurality of scan lines SL1 through SLn and a plurality of data lines DL1 through DLm. In one embodiment, the display panel 100 provides to the luminance compensator 500 degradation information, such as stress information or lifetime information, of the pixels P generated by a pixel sensor. The degradation information may include display time, grayscale level, luminance level, temperature of pixels, etc. The degradation information may be generated for every pixel P or every pixel block, represented as PB1 and PB2 in FIG. 1, each block having a predetermined group of pixels P. In some embodiments, each of the pixels P may be a sub pixel. Each sub pixel emits one of red, green, or blue light. In some embodiments, a temperature weight for compensating the luminance is determined for each pixel block.

According to exemplary embodiments, the scan driver 200 transmits scan signals to the display panel 100 via the scan lines SL1 through SLn. The scan driver 200 transmits the scan signals to the display panel 100 based on a first control signal CON1 received from the timing controller 400.

According to exemplary embodiments, the data driver 300 transmits data signals to the display panel 100 via the data lines DL1 through DLm. The data driver 300 transmits the data signals to the display panel 100 based on a second control signal CON2 received from the timing controller 400. In some embodiments, the data signals correspond to image compensation data DATA2. In some embodiments, the data driver 300 includes a gamma compensator or a gamma voltage generator for converting the image compensation data DATA2 into a voltage that corresponds to the data signal. The image compensation data DATA2 represented by a plurality of grayscale levels is converted into data voltages by a gamma compensator. In some embodiments, the gamma compensator is separated from the data driver 300.

According to exemplary embodiments, the timing controller 400 receives input image data DATA1 from an external source and controls the scan driver 200 and the data driver 300. The timing controller 400 generates the first and second control signals CON1 and CON2, and transmits the first and second control signals CON1 and CON2 to the scan driver 200 and the data driver 300, respectively. The timing controller 400 receives luminance compensation data COMP from the luminance compensator 500. The timing controller 400 applies the luminance compensation data COMP to the input image data DATA1 to generate image compensation data DATA2 and outputs the image compensation data DATA2. In some embodiments, the timing controller 400 further controls the luminance compensator 500. In some embodiments, the timing controller 400 physically includes the luminance compensator 500.

According to exemplary embodiments, the luminance compensator 500 generates the luminance compensation data COMP to compensate afterimages, luminance differences, etc, based on the input image data DATA1. The luminance compensator 500 accumulates the input image data DATA1 or the image compensation data DATA2 to calculate average luminance of each pixel block. The luminance compensator 500 applies a weight based on emission time, a weight based on luminance change, a weight based on pixel temperature, etc., to the average luminance to generate the luminance compensation data COMP. In some embodiments, the luminance compensator 500 outputs temperature compensation data, such as temperature compensation coefficients, for the luminance compensation data COMP based on the temperature change of each pixel block. The luminance compensator 500 outputs the temperature compensation data based on thermal convection and thermal conduction due to heat generation in the display panel 100. Hereinafter, constructions and operations of the luminance compensator 500 for outputting the temperature compensation data will be described with reference to FIGS. 2 through 9.

Figure 2:
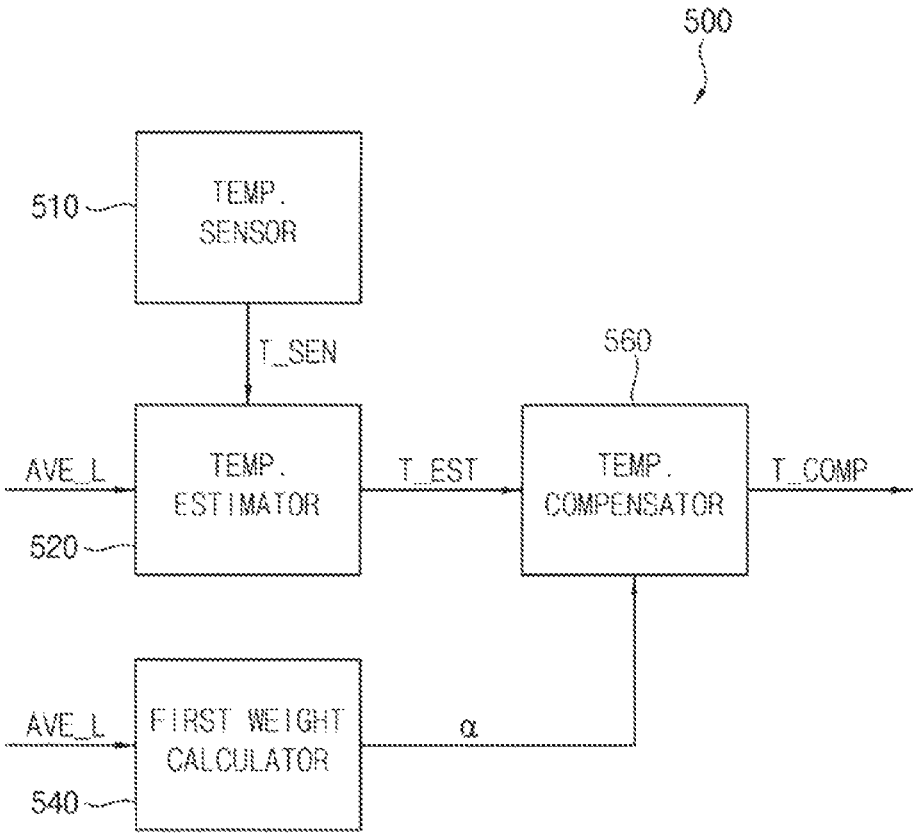
FIG. 2 is a block diagram of a luminance compensator in a display device according to exemplary embodiments.
Figure 3A:
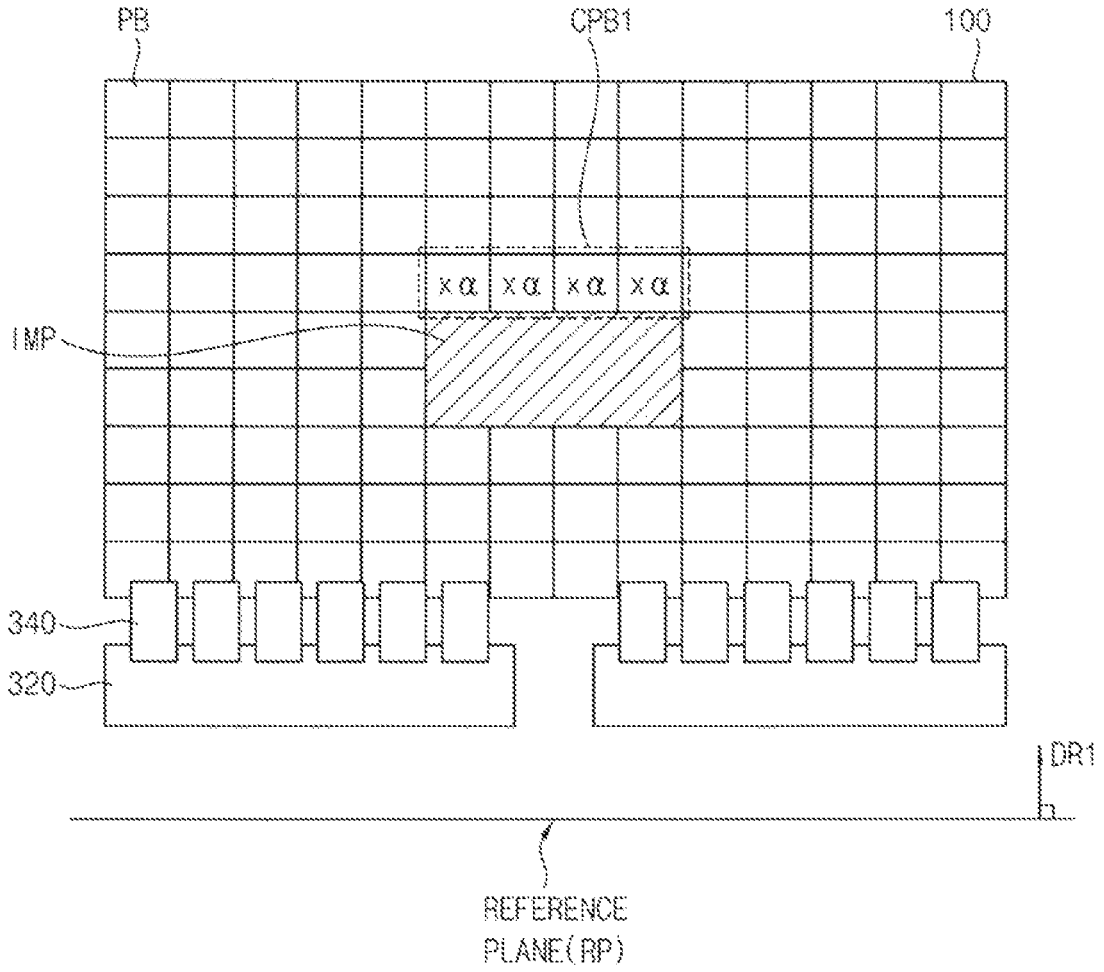
FIGS. 3A and 3B illustrate an example of a temperature compensating operation of a luminance compensator of FIG. 2.
Figure 3B:
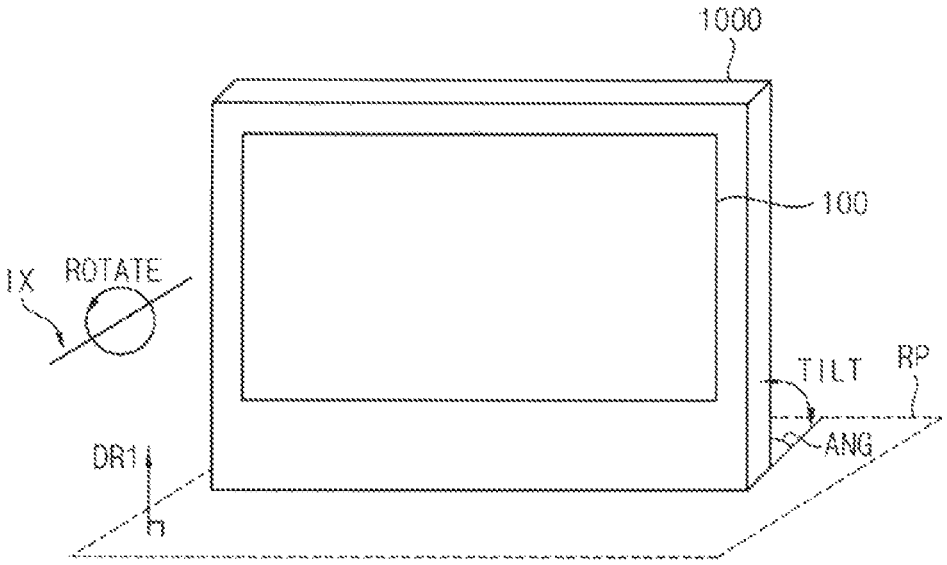

FIG. 2 is a block diagram of a luminance compensator in a display device according to exemplary embodiments. FIGS. 3A and 3B illustrate an example of a temperature compensating operation of a luminance compensator of FIG. 2.

Referring to FIGS. 2 through 3B, according to embodiments, the luminance compensator 500 includes a temperature sensor 510, a temperature estimator 520, a first weight calculator 540, and a temperature compensator 560.

In some embodiments, the luminance compensator 500 further generates compensation data or compensation weights based on emission time, luminance, and grayscale of each pixel, etc. The luminance compensator 500 further includes a data accumulator to accumulate image data by every pixel block PB and an average luminance calculator to calculate an average luminance AVE_L of each pixel block PB in predetermined sampling periods based on the accumulated image data.

According to exemplary embodiments, the temperature sensor 510 detects a temperature T_SEN of a display panel 100. The temperature T_SEN of the display panel 100 is transmitted to the temperature estimator 520. The temperature T_SEN of the display panel 100 is a reference temperature for estimating temperatures of each pixel block PB by the temperature estimator 520.

According to exemplary embodiments, the temperature estimator 520 calculates an estimated temperature T_EST of each of a plurality of pixel blocks PB based on the average luminance AVE_L of each pixel blocs PB and the temperature T_SEN of the display panel 100. The temperature of each pixel block PB can be changed by the luminance. For example, the temperature of a pixel block PB emitting a high luminance may be higher than the temperature of a pixel block PB emitting a low luminance. In some embodiments, the temperature estimator includes a lookup table that stores estimated temperature data for predetermined luminance levels. Thus, the temperature estimator 520 extracts the estimated temperature T_EST of each pixel block PB for its average luminance AVE_L from the lookup table. The temperature T_SEN of the display panel 100 is a reference temperature of the display panel 100. The lookup table is divided into a plurality of lookup tables according to the temperature data. Accordingly, estimated temperatures T_EST corresponding to the same average luminance AVE_L may differ, depending on differences of the detected temperature T_SEN of the display panel 100. For example, the estimated temperature T_EST corresponding to a luminance level of 255 and a temperature T_SEN of 25° C. may differ from the estimated temperature T_EST corresponding to the luminance level of 255 and the temperature T_SEN of 30° C.

According to exemplary embodiments, the first weight calculator 540 detects the placement of the display panel 100 and calculates a first temperature compensation weight α for first compensation pixel blocks CPB1 of the pixel blocks. The first compensation pixel blocks CPB1 may be adjacent to an upper side of an image pattern area IMP of the display panel 100. The first compensation pixel blocks CPB1 may be changed by the placement of the display panel 100. For example, the image pattern area IMP may always be between the first compensation pixel blocks CPB1 and a reference plane RP. The reference plane RP may be determined as a ground surface. In some embodiments, the first weight calculator 540 determines the first temperature compensation weight α based on thermal diffusion inside a display panel due to power consumption. Namely, heat is generated by light emission at the image pattern area IMP, and the heat flows upwards, i.e., in direction DR1 of FIGS. 3A and 3B, due to conduction. The first weight calculator 540 calculates the first temperature compensation weight α that is applied to the first compensation pixel blocks CPB1 to prevent luminance changes due to thermal diffusion.

In some embodiments, the first weight calculator 540 selects the first compensation pixel blocks CPB1 based on the placement of the display panel 100. FIGS. 3A and 3B show that a display surface of the display panel 100 is placed substantially perpendicular, i.e., in the direction DR1, to the virtual reference plane RP. For example, the display panel may be attached to or hung on a wall perpendicular to the reference plane RP, or may be placed above the reference plane RP in the perpendicular direction DR1. According to embodiments, driver ICs 320 that include data drivers and flexible circuit boards 340 that electrically connect the driver IC 320 and the display panel 100 are positioned at a lower side of the display panel 100. As illustrated in FIG. 3A, the first compensation pixel blocks CPB1 are directly adjacent to the upper side of the image pattern area IMP. The first weight calculator 540 can change the first compensation pixel blocks CPB1 based on a rotation of the display panel 100 or a displacement of the display panel 100. For example, the first weight calculator 540 can determine that pixel blocks adjacent to the upper side of the image pattern area IMP with respect to the reference plane RP are the first compensation pixel blocks CPB1. The first temperature compensation weight α may be the same as or different for each pixel block of the first compensation pixel blocks CPB1.

As illustrated in FIG. 3B, the display panel 100 can be rotated around a virtual rotation axis IX that is substantially parallel to the reference plane RP. The display panel 100 may be tilted at a specific displacement angle ANG with respect to the reference plane RP. For example, the displacement angle ANG may be within a range from about 0° to about 90°. However, the range of the displacement angle ANG is not limited thereto in other embodiments.

In some embodiments, the display device 1000 or the first weight calculator 540 further includes a detector that detects the rotation and displacement angle ANG of the display panel 100. Accordingly, the placement of the display surface of the display panel 100 can be determined by the degree of the rotation of the display panel 100 and the displacement angle ANG between the reference plane RP and the display panel 100.

In some embodiments, the first weight calculator 540 calculates the first temperature compensation weight α when the displacement angle ANG is greater than or equal to a predetermined threshold angle. For example, when the threshold angle is set to 10° and the displacement angle ANG is less than 10°, the first temperature compensation weight α is not calculated. When the display surface is placed substantially parallel to the reference plane RP, thermal influence in the display panel 100 may be insignificant so that the first weight calculator 540 does not calculate the first temperature compensation weight α.

In some embodiments, the first weight calculator 540 adjusts the first temperature compensation weight α based on the displacement angle ANG. For example, as the displacement angle ANG increases, the first temperature compensation weight α increases.

According to embodiments, the temperature compensator 560 calculates temperature compensation data T_COMP, such as temperature compensation coefficients, by applying the first temperature compensation weight α to the estimated temperature T_EST and outputs temperature compensation data T_COMP to compensate the average luminance AVE_L. The temperature compensator 560 applies the first temperature compensation weight α to the estimated temperature T_EST of the first compensation pixel blocks CPB1. In some embodiments, the temperature compensator 560 multiplies or scales the first temperature compensation weight α to the estimated temperature T_EST and outputs the resulting temperature compensation data T_COMP. In some embodiments, the temperature compensator 560 adds the first temperature compensation weight α to the estimated temperature T_EST and outputs the resulting temperature compensation data T. COMP.

In some embodiments, the luminance compensator 500 further includes a second weight calculator that calculates a second temperature compensation weight that is applied to second compensation pixel blocks of the pixel blocks based on a distance between a first pattern area having a first luminance and a second pattern area having a second luminance less than the first luminance. The second pixel blocks are included the second pattern area.

As described above, according to embodiments, the luminance compensator 500 applies the first temperature compensation weight α associated with thermal diffusion to the temperature compensation data T_COMP based on the placement of the display panel 100, to improve the accuracy of temperature calculations and improve the compensation image data in the pixel blocks. Thus, a luminance compensation capability of the luminance compensator 500 for eliminating degradations and afterimages may be improved.

Figure 4:
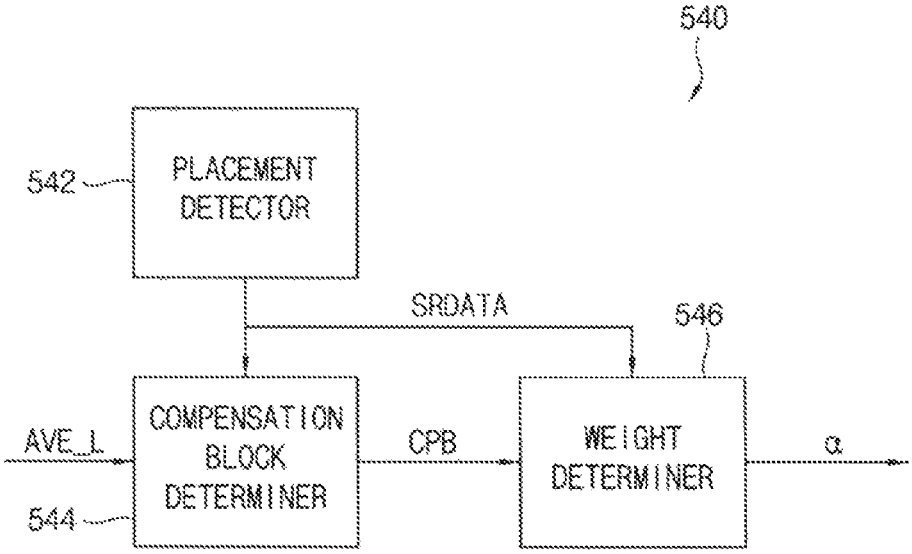
FIG. 4 is a block diagram of an example of a first weight calculator included in a luminance compensator of FIG. 2.

FIG. 4 is a block diagram of an example of a first weight calculator included in a luminance compensator of FIG. 2.

Referring to FIGS. 2 through 4, according to exemplary embodiments, the first weight calculator 540 includes a placement detector 542, a compensation block determiner 544, and a weight determiner 546.

According to exemplary embodiments, the placement detector 542 detects the placement of the display panel 100 based on a displacement angel ANG between a predetermined reference horizontal plane RP and a display surface of the display panel 100 and a degree of rotation ROTATE of the display panel 100. The placement detector 542 generates placement data SRDATA by detecting the placement of the display panel 100. For example, the placement detector 542 includes sensors, such as a gravity sensor, a tilt sensor, a gyro sensor, etc., for detecting displacement of the display panel 100. The placement detector 542 may also receive detected data from sensors, such as the gravity sensor, the tilt sensor, the gyro sensor, etc., included in an electronic device that incorporates the display device, and generates the placement data SRDATA based on the detected data.

According to exemplary embodiments, the compensation block determiner 544 determines first compensation pixel blocks CPB1 that are adjacent to an upper side of a pattern area displayed on a portion of the display panel 100. For example, the compensation block determiner 544 receives the placement data SRDATA from the placement detector 542 and generates data CPB that includes coordinate information of the first compensation pixel blocks CPB1 based on the placement data SRDATA and the average luminance AVE_L.

According to exemplary embodiments, the weight determiner 546 determines the first temperature compensation weight α based on the average luminance AVE_L and the displacement angle ANG. In some embodiments, the weight determiner 546 adjusts the first temperature compensation weight α based on the displacement angle ANG. For example, the first temperature compensation weight α increases as the displacement angle ANG increases.

Figure 5:
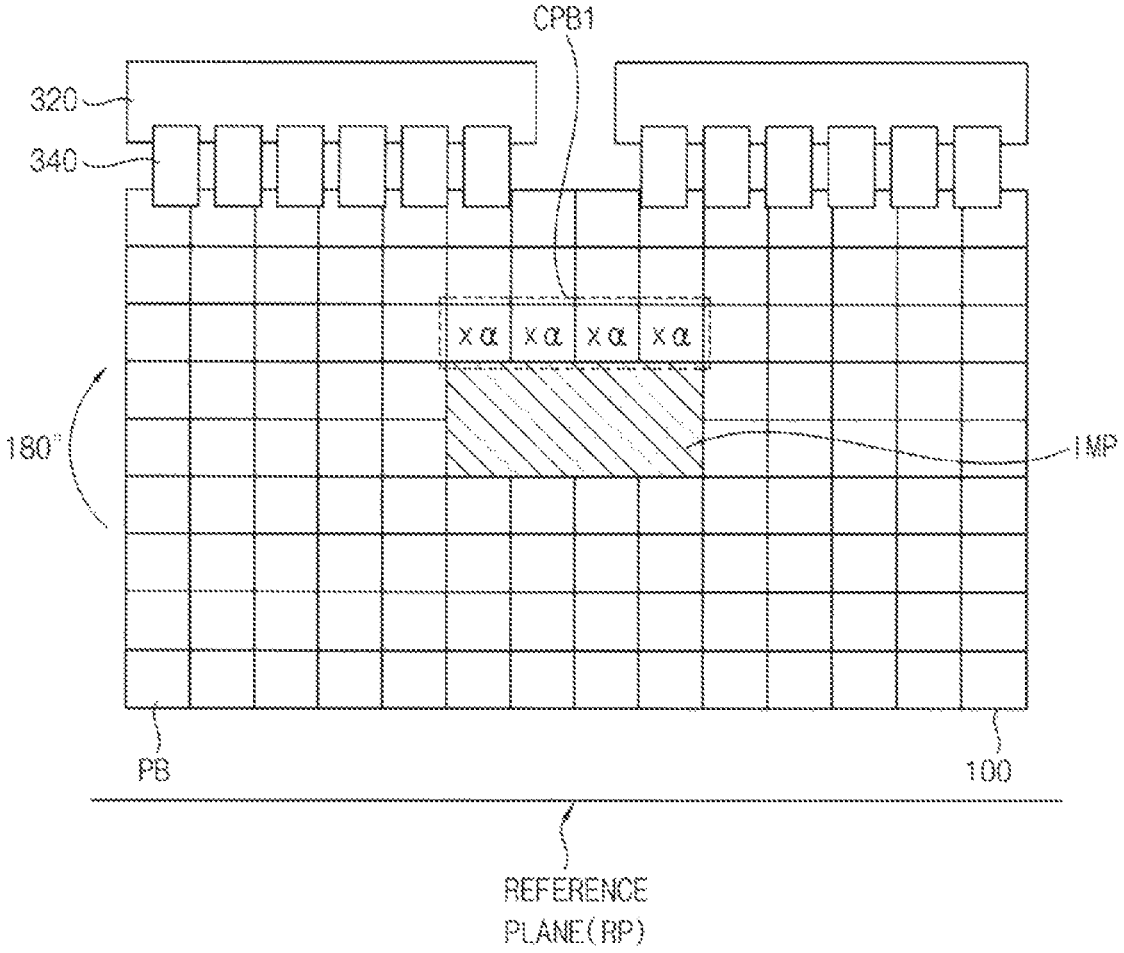
FIG. 5 illustrates another example of a temperature compensating operation of a luminance compensator of FIG. 2.
Figure 6:
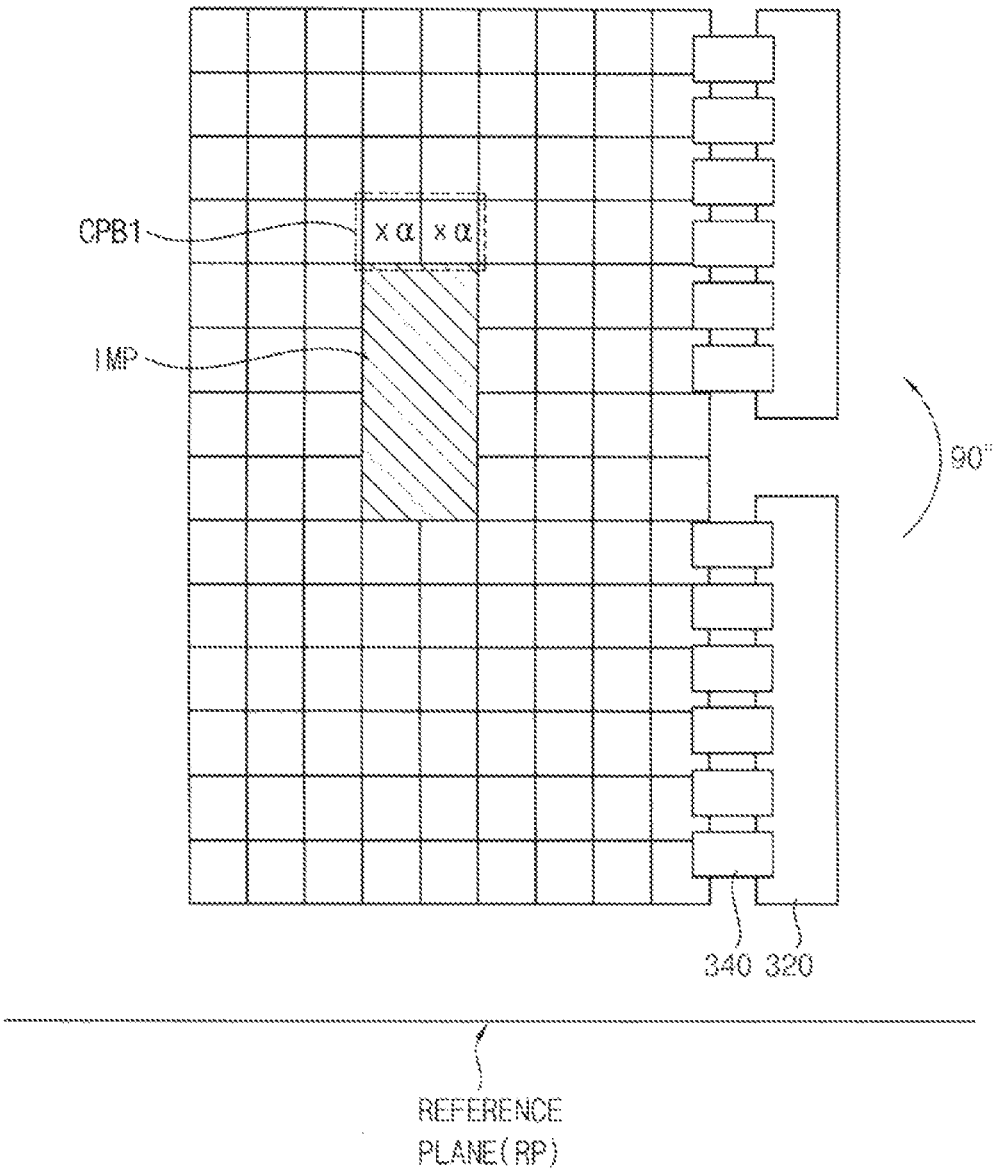
FIG. 6 illustrates still another example of a temperature compensating operation of a luminance compensator of FIG. 2.

FIG. 5 illustrates another example of a temperature compensating operation of a luminance compensator of FIG. 2. FIG. 6 illustrates still another example of a temperature compensating operation of a luminance compensator of FIG. 2.

Referring to FIGS. 2 through 6, according to embodiments, the first compensation pixel blocks CPB change based on the degree of rotation of the display panel 100.

As illustrated in FIG. 5, according to an embodiment, the display panel 100 of FIG. 3 can rotate about 180° around the rotation axis. The first weight calculator 540 can detect the rotation and a placement of the display panel 100 and determine the first compensation pixel blocks CPB1. Accordingly, the first weight calculator 540 determines pixel blocks adjacent to an upper side of a pattern area IMP with respect to the reference horizontal plane RP as the first compensation pixel blocks CPB1.

As illustrated in FIG. 6, according to an embodiment, the display panel 100 of FIG. 3 can rotate in a counterclockwise about 90° around the rotation axis. The first weight calculator 540 determines pixel blocks adjacent to an upper side of a pattern area IMP with respect to the reference horizontal plane RP as the first compensation pixel blocks CPB1.

According to exemplary embodiments, the luminance compensator 500 applies the first temperature compensation weight α to the first compensation pixel blocks CPB1 to calculate temperature compensation data. The first temperature compensation weight α may be added to or multiplied by the estimated temperature.

As described above, according to exemplary embodiments, the first compensation pixel blocks CPB1 to which the first temperature compensation weight α is applied may change based on the placement, e.g. a degree of rotation, of the display panel 100, to improve the accuracy of the temperatures calculations and improve the compensation of image data in the pixel blocks.

Figure 7:
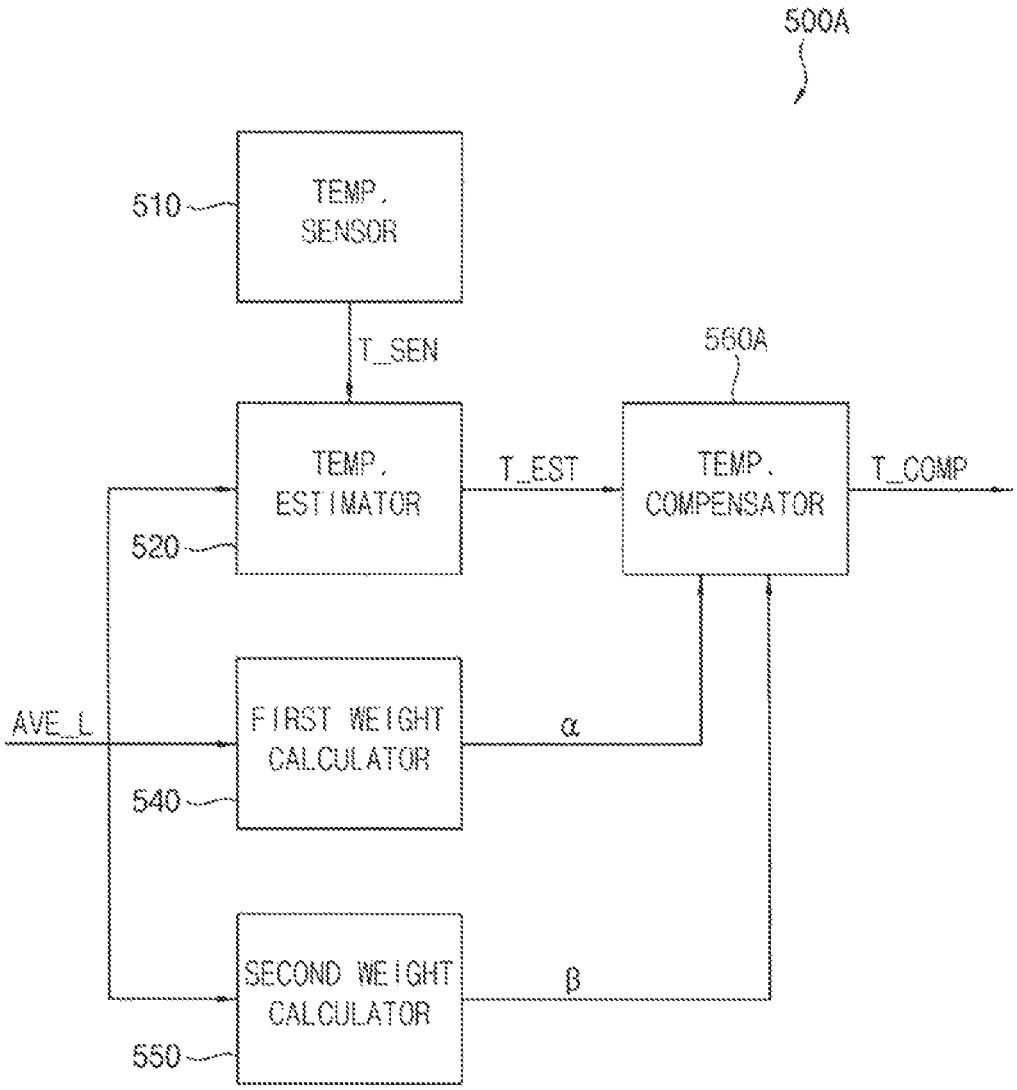
FIG. 7 is a block diagram of an example of a luminance compensator of FIG. 2.
Figure 8:
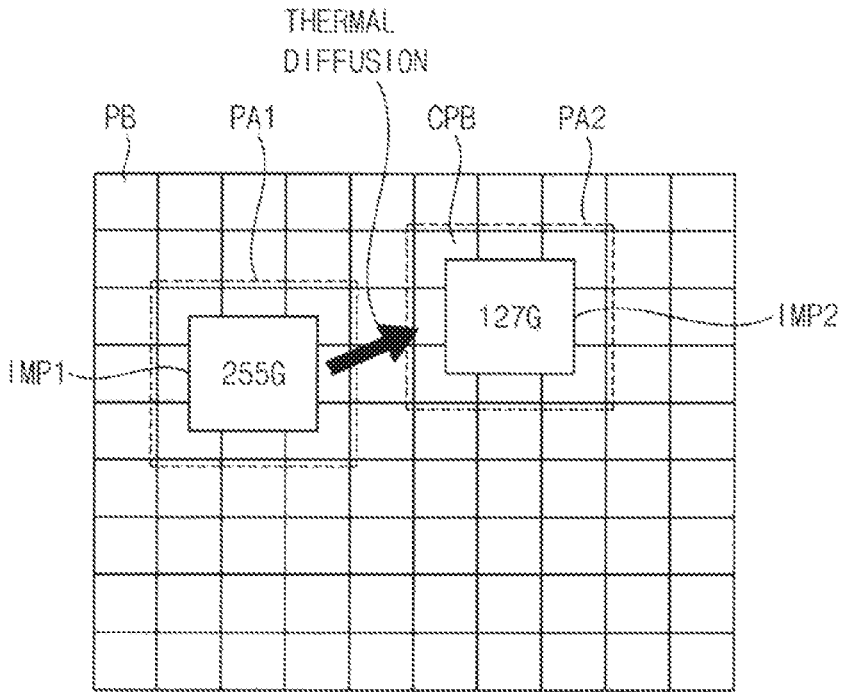
FIG. 8 illustrates an example in which a first pattern area and a second pattern area are displayed on a display panel.

FIG. 7 is a block diagram of an example of a luminance compensator of FIG. 2. FIG. 8 illustrates an example in which a first pattern area and a second pattern area are displayed on a display panel.

In FIG. 7, similar reference numerals are used to designate elements of the cover window that are similar to those of FIG. 2, and detailed description of these elements is omitted. A luminance compensator of FIG. 7 is substantially the same as or similar to a luminance compensator of FIG. 2 except for a second weight calculator 550.

Referring to FIGS. 7 and 8, according to exemplary embodiments, the luminance compensator 500A includes a temperature sensor 510, a temperature estimator 520, a first weight calculator 540, a second weight calculator 550, and a temperature compensator 560A.

According to exemplary embodiments, the temperature sensor 510 can detect a temperature T_SEN of a display panel 100.

According to exemplary embodiments, the temperature estimator 520 calculates an estimated temperature T_EST of each of a plurality of pixel blocks PB based on the average luminance AVE_L of each pixel block PB and the temperature T_SEN of the display panel 100. The temperature of each pixel block PB may be changed by the luminance.

According to exemplary embodiments, the first weight calculator 540 detects a placement of the display panel 100 and calculates a first temperature compensation weight α to be applied to the first compensation pixel blocks of the pixel blocks PB. The first compensation pixel blocks are adjacent to an upper side of an image pattern area IMP of the display panel 100.

According to exemplary embodiments, the second weight calculator 550 calculates a second temperature compensation weight β to be applied to second compensation pixel blocks of the pixel blocks PB based on a distance between a first pattern area PA1 having a first luminance and a second pattern area PA2 having a second luminance lower than the first luminance. The second pixel blocks are included the second pattern area PA2. In some embodiments, the second weight calculator 550 decreases the second temperature compensation weight β with an increasing distance. The second weight calculator 550 applies the second temperature compensation weight β to pixel blocks corresponding to at least a portion of the second pattern area PA2 based on thermal conduction due to temperature differences between the first pattern area PA1 and the second pattern area PA2. That is, if the first pattern area PA1 is brighter than the second pattern area PA2, a temperature difference between the first pattern area PA1 and the second pattern area PA2 may occur. Since the temperature of the second pixel area PA2 changes due to thermal conduction, the second weight calculator 550 calculates the second temperature compensation weight β to reflect thermal conduction. In some embodiments, the second weight calculator 550 includes a luminance map calculator, a distance calculator, and a weight determiner.

For example, in some embodiments, as illustrated in FIG. 8, the first pattern area PA1 includes a first image pattern IMP1 having a first luminance corresponding to a 255 grayscale level and the second pattern area PA2 includes a second image pattern IMP2 having a second luminance corresponding to a 127 grayscale level. Thus, the second luminance is lower than the first luminance. In this case, thermal diffusion occurs from the first pattern area PA1 to the second pattern area PA2 in the form of thermal conduction. Thus, the second weight calculator 550 performs an additional temperature compensation with respect to the pixel blocks CPB in the second pattern areas PA2.

In some embodiments, the second weight calculator 550 determines the second temperature compensation weight β of each of the second compensation pixel blocks CPB differently based on a relative distance between the first pattern area PA1 and each of the second compensation pixel blocks CPB. For example, portions of the second compensation pixel blocks CPB that are closer to the first pattern area PA1 have a greater second temperature compensation weight β than other portions of the second compensation pixel blocks CPB.

In some embodiments, the second weight calculator 550 adjusts the second temperature compensation weight β based on luminance differences between the first image pattern area PA and the second image pattern area PA2. For example, the second temperature compensation weight β increases with an increasing luminance difference.

According to exemplary embodiments, the second weight calculator 550 does not calculate the second temperature compensation weight β when there is a middle area between the first and second pattern areas PA1 and PA2. Accordingly, the second temperature compensation weight β is not applied to the temperature compensation data T_COMP. According to embodiments, the middle area may have a luminance below a predetermined threshold luminance, and both of the first and second image pattern areas PA1 and PA2 have higher luminance than the threshold luminance.

According to exemplary embodiments, the temperature compensator 560A calculates the temperature compensation data T_COMP by applying the first temperature compensation weight α to the estimated temperature T_EST to compensate the average luminance AVE_L. The temperature compensator 560A further applies the second temperature compensation weight β to the temperature compensation data T_COMP. Accordingly, the luminance compensator 500A outputs the temperature compensation data T_COMP to compensate for thermal diffusions that resulted from the placement of the display panel 100 and from luminance differences between the image patterns.

Thus, temperature compensation values of pixels that compensate for degradation and afterimage of the display device 1000 may be calculated more accurately.

Figure 9:
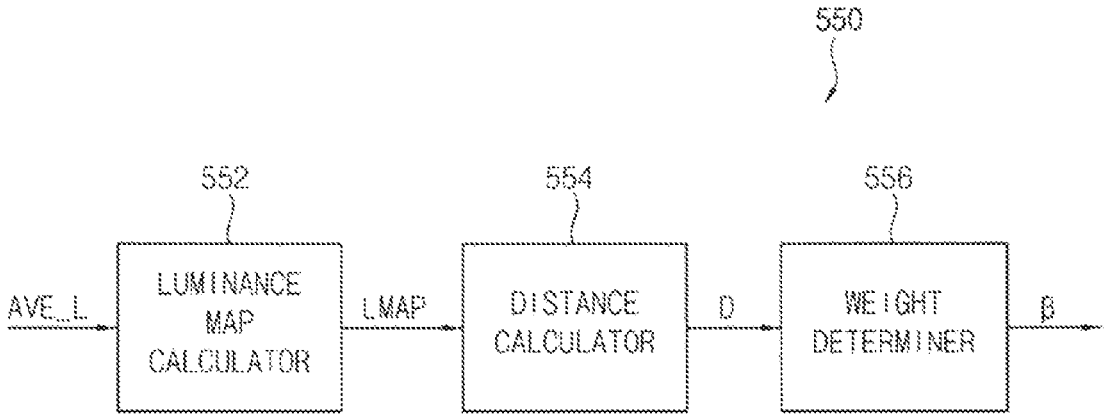
FIG. 9 is a block diagram of an example of a second weight calculator included in a luminance compensator of FIG. 7.
Figure 10:
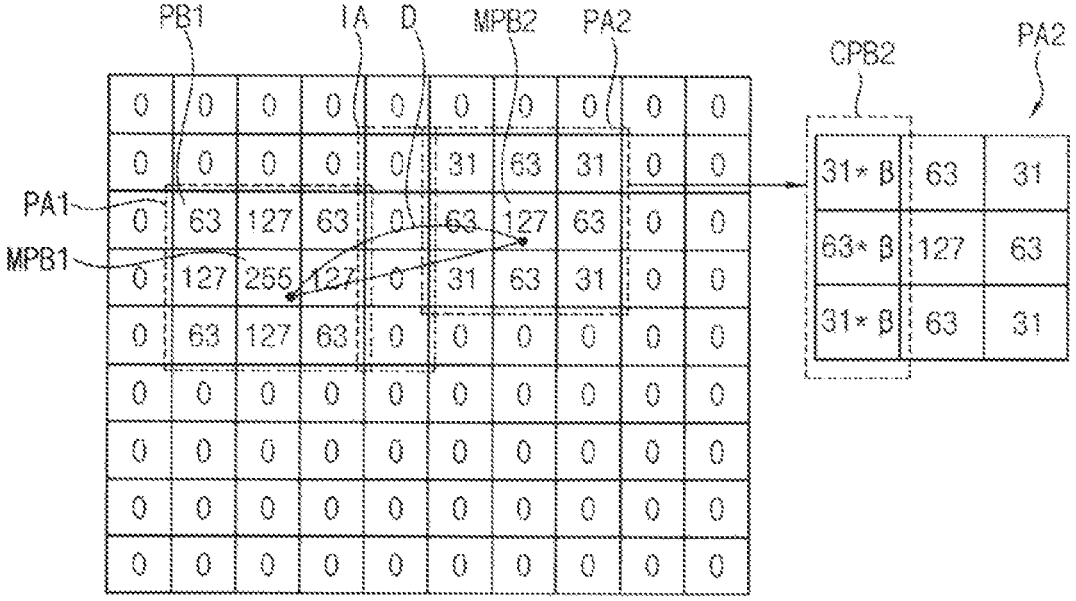
FIG. 10 illustrates an example in which a luminance compensator of FIG. 7 performs temperature compensation with respect to a second pattern area of FIG. 8.

FIG. 9 is a block diagram of an example of a second weight calculator included in a luminance compensator of FIG. 7. FIG. 10 illustrates an example of which a luminance compensator of FIG. 7 performs temperature compensation with respect to a second pattern area of FIG. 8.

Referring to FIGS. 9 and 10, according to embodiments, the second weight calculator 550 includes a luminance map calculator 552, a distance calculator 554, and a weight determiner 556.

According to exemplary embodiments, the luminance map calculator 552 extracts a luminance map LMAP that matches each of the pixel blocks PB with the average luminance AVE_L, in a frame. The luminance map calculator 552 determines a first pattern area PA1, a second pattern area PA2, and a middle area IA between the first and second pattern areas PA1 and PA2 based on the luminance map LMAP. The middle area has a luminance below a predetermined threshold luminance. The luminance map calculator 552 extracts the luminance map LMAP based on the average luminance AVE_L data received from an external device. FIG. 10 shows the luminance map LMAP of an image having image patterns IMP1 and IMP2 of FIG. 8. The first pattern area PA1 may include a first image pattern IMP1 that emits first luminance corresponding to a 255 grayscale level. A pixel block in the center of the first pattern area PA1 has a 255 grayscale level average luminance. In a pixel block PB1 in the first pattern area PA1 having a 63 grayscale level average luminance, only ¼ of the pixel blocks PB1 emit light at the 255 grayscale level. Thus, the pixel block PB1 may have an average luminance in the luminance map LMAP corresponding to a 63 grayscale level. Similarly, the second pattern area PA2 may include a second image pattern IMP2 that emits a second luminance corresponding to a 127 grayscale level. Here, pixel blocks except for the first and second pattern areas PA1 and PA2 have average luminances corresponding to a zero grayscale level, i.e., black.

In some embodiments, the luminance map calculator 552 determines the middle area IA by comparing the threshold luminance with the average luminance of each pixel block PB. Here, the middle area IA may have pixel blocks with an average luminance AVE_L below the threshold luminance. The first pattern area PA1 and the second pattern area PA2 may have the luminances greater than the threshold luminance.

According to exemplary embodiments, the distance calculator 554 calculates the distance D between a first maximum luminance block MPB1 included in the first pattern area PA1 and a second maximum luminance block MPB2 included in the second pattern area PA2. The distance calculator 554 determines the first maximum luminance block MPB1 and the second maximum luminance block MPB2 based on the luminance map LMAP. The distance calculator 554 calculates the distance D using coordinates of the first maximum luminance block MPB1 and coordinates of the second maximum luminance block MPB2. In some embodiments, the distance calculator 554 does not calculate the distance D when no middle area IA is detected between the first and second pattern areas PA1 and PA2.

According to exemplary embodiments, the weight determiner 556 determines the second compensation pixel blocks CPB2 and the second temperature compensation weight β based on the distance D. In some embodiments, the weight determiner 556 determines the second temperature compensation weight β of each of the second compensation pixel blocks CPB2 differently based on the distance D. For example, as illustrated in FIG. 10, the second compensation pixel blocks CPB2 may include boundary pixel blocks in the second pattern area PA2 that are relatively closer to the first pattern area PA1. However, these are examples, and the second compensation pixel blocks CPB2 may be determined in various ways. For example, the second the second compensation pixel blocks CPB2 may be other pixel blocks in the second pattern area PA2 when the distance D is less than a predetermined reference distance or the luminance difference between the first image pattern area PA1 and the second image pattern area PA2 is less than a predetermined reference luminance difference.

In some embodiments, the weight determiner 556 adjusts the second temperature compensation weight β based on a luminance difference between the first maximum luminance block MPB1 and the second maximum luminance block MPB2. For example, the second temperature compensation weight β increases as the luminance difference increases.

In some embodiments, the weight determiner 556 decreases the second temperature compensation weight β as the distance D increases, because the influence of thermal diffusion is reduced increasing distance D.

In some embodiments, the estimated temperature T_EST is scaled by the second temperature compensation weight β. In some other embodiments, the second temperature compensation weight β is added to the estimated temperature T_EST to calculate and output the temperature compensation data T_COMP.

According to exemplary embodiments, as described above, the luminance compensator 500A applies the first temperature compensation weight α concerned with the thermal diffusion (i.e., the thermal convection) according to the placement of the display panel 100 and the second temperature compensation weight β concerned with the thermal diffusion (i.e., the thermal conduction) according to the luminance difference between pattern areas to the temperature compensation data T_COMP, to improve the accuracy of the temperature calculations and the compensation of image data for the pixel blocks. Thus, a luminance compensation capability of the luminance compensator 500 for eliminating degradations and afterimages may be improved.

Figure 11:
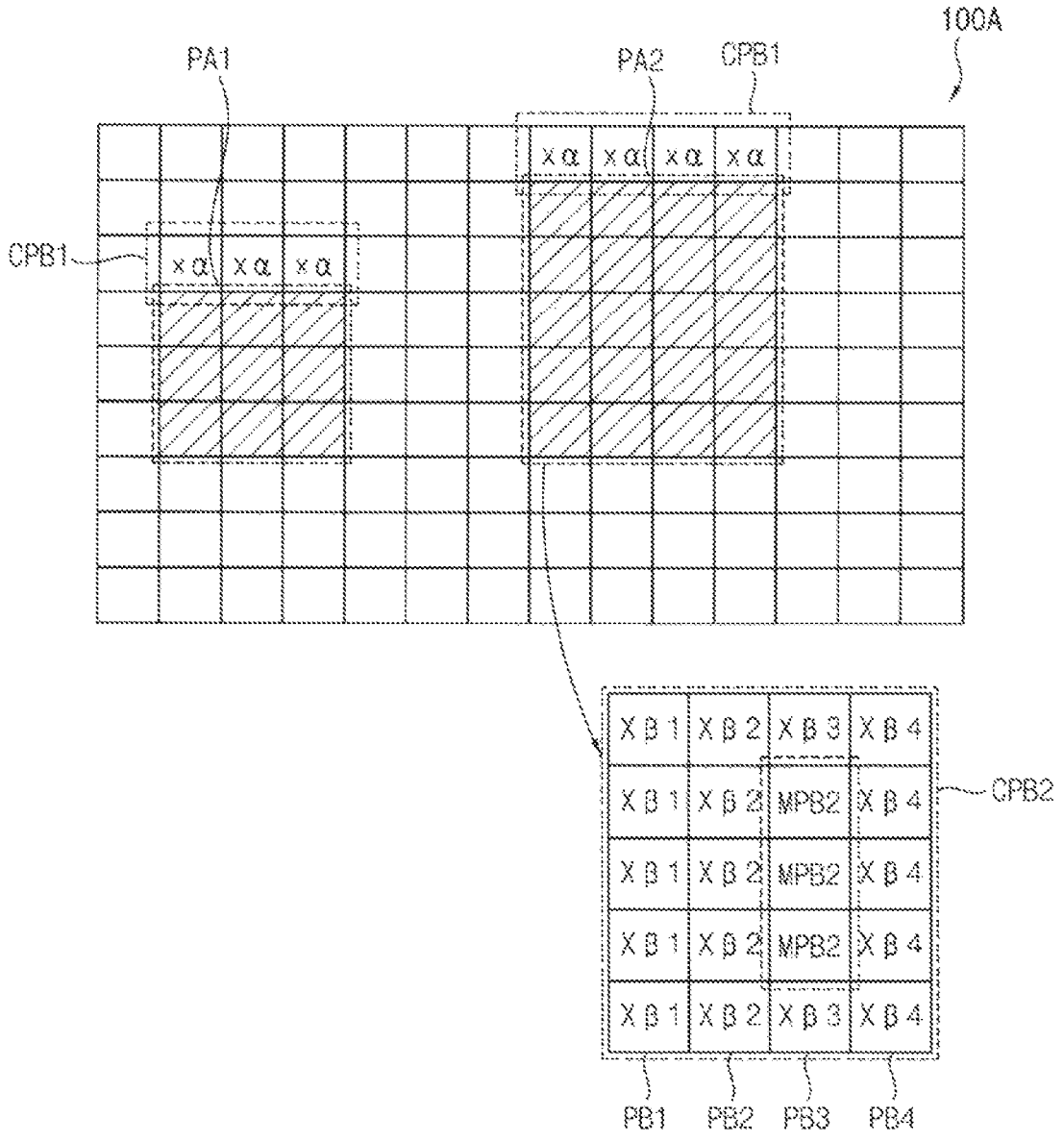
FIG. 11 illustrates an example in which a luminance compensator of FIG. 7 performs temperature compensation.

FIG. 11 illustrates an example in which a luminance compensator of FIG. 7 performs temperature compensation.

Referring to FIG. 11, according to exemplary embodiments, the luminance compensator 500A applies a first temperature compensation weight α and a second temperature compensation weight β to temperature compensation data of corresponding pixel blocks based on a placement of the display panel 100A and luminance differences between first and second pattern areas PA1 and PA2.

According to an embodiment, a display surface of the display panel 100A is placed substantially perpendicular to a virtual reference plane, such as a ground surface.

According to exemplary embodiments, a first weight calculator applies the first temperature compensation weight α to first compensation pixel blocks CPB1 that are adjacent to the upper sides of the pattern areas PA1 and PA2. Thus, a temperature change and a luminance change due to thermal diffusion resulting from the placement of the display panel 100A can be compensated.

According to exemplary embodiments, a second weight calculator applies second temperature compensation weights β1, β2, β3, and β4 to second compensation pixel blocks CPB2 in the second pattern area PA2. The average luminance of the second pattern area PA2 may be lower than the average luminance of the first pattern area PA1. According to an embodiment, first pixel blocks PB1 of the second compensation pixel blocks CPB2 are closer to the first pattern area PA1 than second, third, and fourth pixel blocks PB2, PB3, and PB4. Thus, the second temperature compensation weight β1 of first pixel blocks PB1 is greater than the second temperature compensation weights β2, β3, and β4 of the second, third, and fourth pixel blocks PB1, PB2, PB3, and PB4. The first pixel blocks PB1 correspond to a first pixel block column. Similarly, the second through fourth pixel blocks PB2, PB3, and PB4 correspond to second through fourth pixel block columns, respectively.

In some embodiments, the second temperature compensation weights β1, β2, β3, and β4 differ each other based on relative distances to the first pattern area PA1.

Accordingly, according to exemplary embodiments, the luminance compensator 500A applies the first temperature compensation weight α and the second temperature compensation weights β1, β2, β3, and β4, calculated based on thermal diffusion resulting from the placement of the display panel 100A and luminance differences between pattern areas, to the temperature compensation data, to improve the accuracy of the temperature calculations and the compensation of the image data for the pixel blocks.

Figure 12:
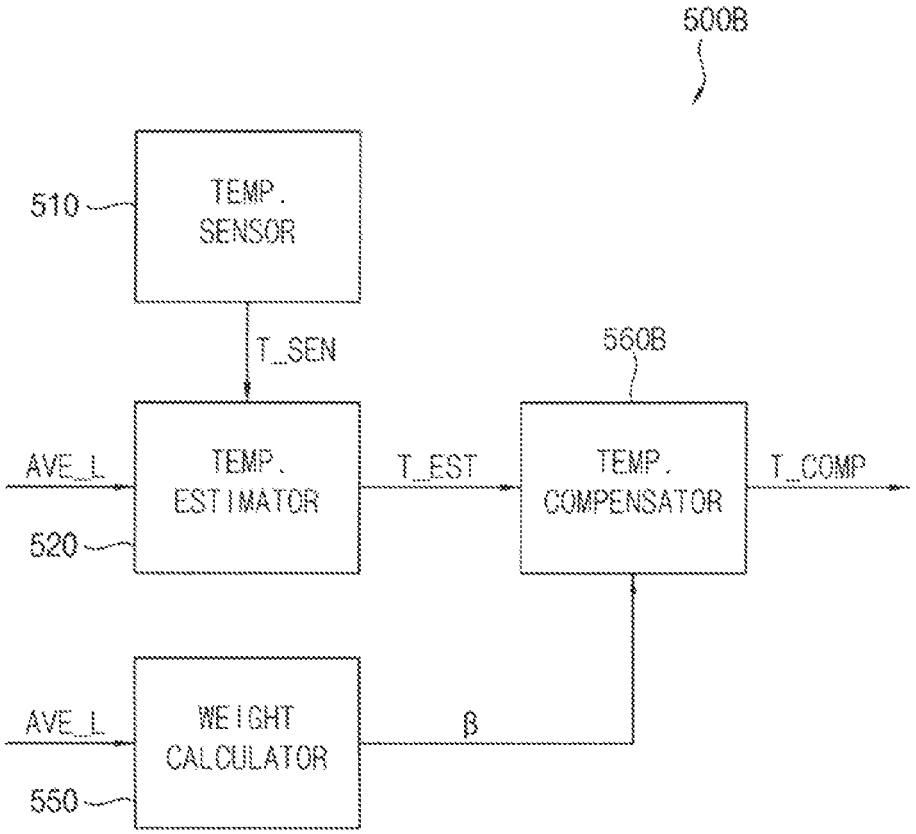
FIG. 12 is a block diagram of a luminance compensator according to exemplary embodiments.

FIG. 12 is a block diagram of a luminance compensator according to exemplary embodiments.

In FIG. 12, like reference numerals may be used to designate elements similar to those in FIG. 7, and detailed description of these elements is omitted. A luminance compensator of FIG. 12 is substantially the same as or similar to a luminance compensator of FIG. 7 except for the first weight calculator.

Referring to FIG. 12, according to exemplary embodiments, a luminance compensator 500B includes a temperature sensor 510, a temperature estimator 520, a weight calculator 550, and a temperature compensator 560B.

According to exemplary embodiments, the temperature sensor 510 can detect a temperature T_SEN of a display panel 100.

According to exemplary embodiments, the temperature estimator 520 calculates an estimated temperature T_EST of each of a plurality of pixel blocks PB based on the average luminance AVE_L of each of the pixel blocks PB and the temperature T_SEN of the display panel 100.

According to exemplary embodiments, the weight calculator 550 calculates a temperature compensation weight β to be applied to compensation pixel blocks of the pixel blocks PB based on a distance between a first pattern area having a first luminance and a second pattern area having a second luminance lower than the first luminance. In some embodiments, the weight calculator 550 decreases the temperature compensation weight β with increasing distance. The second weight calculator 550 applies the temperature compensation weight β to pixel blocks of at least a portion of the second pattern area based on thermal conduction that results from temperature differences between the first pattern area and the second pattern area.

According to exemplary embodiments, the temperature compensator 560B calculates temperature compensation data T_COMP by applying the temperature compensation weight β to the estimated temperature T_EST and outputs the temperature compensation data T_COMP. In some embodiments, the temperature compensator 560B may add or scale the temperature compensation weight β to the estimated temperature T_EST.

Accordingly, according to embodiments, the luminance compensator 500B uses the temperature compensation weight β to calculate the temperature compensation data T_COMP based on thermal diffusion resulting from luminance differences between the pattern areas, to improve the accuracy of the temperature calculations and the compensation of image data for the pixel blocks.

In some embodiments, the luminance compensator 500B further includes a second weight calculator that detects a placement of the display panel and calculates a second temperature compensation weight to be applied to the second compensation pixel blocks of the pixel blocks, where the second compensation pixel blocks are adjacent to an upper side of an image pattern area displayed on the display panel. Thus, the luminance compensator 500B further applies the second temperature compensation weight to the temperature compensation data T_COMP based on thermal diffusion resulting from the placement of the display panel, to improve the accuracy of the temperature calculations and the compensation of image data for the pixel blocks.

Exemplary embodiments can be incorporated into any display device and any system that includes a luminance compensator. For example, exemplary embodiments can be incorporated into a transparent display device, a mirror display device, a large size display device such as a billboard, an electronic display board, etc.

The foregoing is illustrative of exemplary embodiments, and is not to be construed as limiting thereof. Although a few exemplary embodiments have been described, those skilled in the art will readily appreciate that many modifications are possible in the exemplary embodiments without materially departing from the novel teachings and advantages of exemplary embodiments. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. Embodiments of the inventive concept are defined by the following claims, with equivalents of the claims to be included therein.

What is claimed is:

1. A luminance compensator in a display device, comprising:

a temperature sensor that detects a temperature of a display panel;

a temperature estimator that calculates an estimated temperature of each of a plurality of pixel blocks based on an average luminance of each pixel block and the temperature of the display panel;

a first weight calculator that detects a placement of the display panel and calculates a first temperature compensation weight of first compensation pixel blocks of the pixel blocks, the first compensation pixel blocks being adjacent to an upper side of an image pattern area displayed on a portion of the display panel; and a temperature compensator that calculates temperature compensation data by applying the first temperature compensation weight to the estimated temperature to compensate the average luminance, and outputs the temperature compensation data.

2. The luminance compensator of claim 1, wherein the first weight calculator determines the first temperature compensation weight based on thermal diffusion inside the display panel that results from a displacement of the display panel.

3. The luminance compensator of claim 1, wherein the first weight calculator selects the first compensation pixel blocks based on the placement of the display panel.

4. The luminance compensator of claim 3, wherein the placement of the display panel is determined based on a degree of rotation of the display panel when a display surface of the display panel is vertical with respect to a predetermined reference horizontal plane.

5. The luminance compensator of claim 3, wherein:

the placement of the display panel is determined based on a displacement angle between a predetermined reference horizontal plane and a display surface of the display panel, and the first weight calculator calculates the first temperature compensation weight when the displacement angle is greater than or equal to a predetermined threshold angle and adjusts the first temperature compensation weight based on the displacement angle.

6. The luminance compensator of claim 1, wherein the first weight calculator comprises:

a placement detector that detects the placement of the display panel based on a displacement angel between a predetermined reference horizontal plane and a display surface of the display panel and a degree of rotation of the display panel;

a compensation block determiner that determines first compensation pixel blocks adjacent to an upper side of an image pattern area displayed on a portion of the display panel; and a weight determiner that determines the first temperature compensation weight based on the average luminance and the displacement angle.

7. The luminance compensator of claim 1, wherein the temperature compensator performs one of adding the first temperature compensation weight to the estimated temperature or multiplying the first temperature compensation weight by the estimated temperature.

8. The luminance compensator of claim 1, further comprising: a second weight calculator that calculates a second temperature compensation weight of second compensation pixel blocks of the pixel blocks based on a distance between a first pattern area having a first luminance and a second pattern area having a second luminance lower than the first luminance, the second pixel blocks being included in the second pattern area, wherein the second weight calculator decreases the second temperature compensation weight as the distance increases.

9. The luminance compensator of claim 8, wherein the temperature compensator further applies the second temperature compensation weight to the temperature compensation data.

10. A luminance compensator in a display device, comprising: a temperature sensor that detects a temperature of a display panel; a temperature estimator that calculates an estimated temperature of each of a plurality of pixel blocks based on an average luminance of each pixel block and the temperature of the display panel; a first weight calculator that calculates a first temperature compensation weight of first compensation pixel blocks of the pixel blocks based on a distance between a first pattern area having a first luminance and a second pattern area having a second luminance lower than the first luminance, the second pixel blocks being included in the second pattern area; and a temperature compensator that calculates temperature compensation data by applying the first temperature compensation weight to the estimated temperature to compensate the average luminance, and outputs the temperature compensation data.

11. The luminance compensator of claim 10, wherein the first weight calculator applies the first temperature compensation weight to at least a portion of the second pattern area based on thermal conduction resulting from temperature differences between the first pattern area and the second pattern area.

12. The luminance compensator of claim 10, wherein the first weight calculator decreases the second temperature compensation weight as the distance increases.

13. The luminance compensator of claim 10, wherein the first weight calculator comprises:

a luminance map calculator that extracts a luminance map that matches each of the pixel blocks with the average luminance in a frame, and determines the first pattern area, the second pattern area, and a middle area between the first and second pattern areas based on the luminance map, the middle area having a luminance below a predetermined threshold luminance;

a distance calculator that calculates the distance between a first maximum luminance block in the first pattern area and a second maximum luminance block in the second pattern area; and a weight determiner that determines the first compensation pixel blocks and the first temperature compensation weight based on the distance.

14. The luminance compensator of claim 13, wherein the weight determiner determines the first temperature compensation weight of each of the first compensation pixel blocks differently based on a relative distance between the first maximum luminance block and each first compensation pixel block and adjusts the first temperature compensation weight based on luminance differences between the first maximum luminance block and the second maximum luminance block, and wherein the distance calculator does not calculate the distance when no middle area is detected between the first and second pattern areas.

15. The luminance compensator of claim 10, further comprising:

a second weight calculator that detects a displacement of the display panel and calculates a second temperature compensation weight of second compensation pixel blocks of the pixel blocks, the second compensation pixel blocks being adjacent to an upper side of an image pattern area displayed on a portion of the display panel.

16. A luminance compensator in a display device, comprising: a temperature sensor that detects a temperature of a display panel; a temperature estimator that calculates an estimated temperature of each of a plurality of pixel blocks based on an average luminance of each pixel block and the temperature of the display panel; a first weight calculator that detects a placement of the display panel and calculates a first temperature compensation weight of first compensation pixel blocks of the pixel blocks, the first compensation pixel blocks being adjacent to an upper side of an image pattern area displayed on a portion of the display panel; and a second weight calculator that calculates a second temperature compensation weight of second compensation pixel blocks of the pixel blocks based on a distance between a first pattern area having a first luminance and a second pattern area having a second luminance lower than the first luminance, the second pixel blocks being included in the second pattern area.

17. The luminance compensator of claim 16, further comprising:

a temperature compensator that calculates temperature compensation data by applying the first temperature compensation weight and the second temperature compensation weight to the estimated temperature to compensate the average luminance, and outputs the temperature compensation data.

18. The luminance compensator of claim 16, wherein the first weight calculator comprises:

a placement detector that detects the placement of the display panel based on a displacement angel between a predetermined reference horizontal plane and a display surface of the display panel and a degree of rotation of the display panel;

a compensation block determiner that determines first compensation pixel blocks adjacent to an upper side of an image pattern area displayed on a portion of the display panel; and a weight determiner that determines the first temperature compensation weight based on the average luminance and the displacement angle.

19. The luminance compensator of claim 16, wherein the second weight calculator comprises: a luminance map calculator that extracts a luminance map that matches each of the pixel blocks with the average luminance in a frame, and determines the first pattern area, the second pattern area, and a middle area between the first and second pattern areas based on the luminance map, the middle area having a luminance below a predetermined threshold luminance; a distance calculator that calculates the distance between a first maximum luminance block in the first pattern area and a second maximum luminance block in the second pattern area; and a weight determiner that determines the second compensation pixel blocks and the second temperature compensation weight based on the distance.

20. The luminance compensator of claim 19, wherein the weight determiner determines the second temperature compensation weight of each of the second compensation pixel blocks differently based on a relative distance between the first maximum luminance block and each second compensation pixel block, and adjusts the second temperature compensation weight based on luminance differences between the first maximum luminance block and the second maximum luminance block, and wherein the distance calculator does not calculate the distance when no middle area is detected between the first and second pattern.

* * * * *